US006626610B1

(12) United States Patent
Seegmiller

(10) Patent No.: US 6,626,610 B1
(45) Date of Patent: Sep. 30, 2003

(54) CABLE BOLT APPARATUS AND METHOD OF INSTALLATION FOR MINES

(76) Inventor: Ben L. Seegmiller, 143 S. 400 East, Salt Lake City, UT (US) 84111

( * ) Notice: Subject to any disclaimer, the term of this patent is extended or adjusted under 35 U.S.C. 154(b) by 0 days.

(21) Appl. No.: 10/112,868

(22) Filed: Apr. 2, 2002

(51) Int. Cl.[7] ..... E21D 20/00; E21D 21/00

(52) U.S. Cl. ..... 405/259.5; 405/259.1; 405/259.4; 405/288; 81/467; 173/93.5; 173/176

(58) Field of Search ..... 405/259.1, 259.4, 405/259.5, 288, 302.2; 173/13, 93.5, 176; 81/467

(56) References Cited

U.S. PATENT DOCUMENTS

| | | | | | |
|---|---|---|---|---|---|
| 788,873 | A | * | 5/1905 | Anderson | 144/219 |
| 817,609 | A | * | 4/1906 | Adams | 279/28 |
| 890,091 | A | * | 6/1908 | Parmeter | 403/274 |
| 906,040 | A | * | 12/1908 | Lucas | 81/120 |
| 1,590,200 | A | * | 6/1926 | McGugkin | 81/120 |
| 2,089,857 | A | * | 8/1937 | Robbins | 403/369 |
| 2,463,144 | A | * | 3/1949 | Buchanan | 439/805 |
| 2,914,984 | A | * | 12/1959 | Ansingh | 411/403 |
| 3,161,090 | A | * | 12/1964 | McLellan | 81/53.2 |
| 3,854,768 | A | * | 12/1974 | King, Sr. | 294/102.1 |
| 3,940,941 | A | * | 3/1976 | Libert et al. | 405/259.6 |
| 3,993,145 | A | * | 11/1976 | Findeli | 173/176 |
| 4,023,373 | A | * | 5/1977 | Hipkins | 405/259.6 |
| 4,611,954 | A | * | 9/1986 | Cassidy | 405/259.6 |
| 4,759,888 | A | * | 7/1988 | Brest van Kempen | 405/259.5 |
| 4,827,811 | A | * | 5/1989 | Vickers | 81/436 |
| 5,064,312 | A | * | 11/1991 | Calandra et al. | 405/259.5 |
| 5,161,916 | A | * | 11/1992 | White et al. | 405/259.6 |
| 5,224,402 | A | * | 7/1993 | Pettersson | 81/467 |
| 5,230,589 | A | * | 7/1993 | Gillespie | 405/259.6 |
| 5,259,703 | A | * | 11/1993 | Gillespie | 405/259.6 |
| 5,511,909 | A | * | 4/1996 | Calandra et al. | 405/259.6 |
| 5,531,545 | A | * | 7/1996 | Seegmiller et al. | 405/259.4 |
| 5,741,092 | A | * | 4/1998 | Castle et al. | 405/302 |
| 5,873,689 | A | * | 2/1999 | Mensour et al. | 411/3 |
| 5,931,064 | A | * | 8/1999 | Gillespie | 81/120 |
| 6,074,134 | A | * | 6/2000 | Stankus et al. | 405/259.6 |
| 6,179,063 | B1 | * | 1/2001 | Borries et al. | 173/93.5 |
| 6,270,290 | B1 | * | 8/2001 | Stankus et al. | 405/259.6 |
| 6,296,429 | B1 | * | 10/2001 | Wright | 411/5 |
| 6,334,494 | B1 | * | 1/2002 | Nagato | 173/93.5 |
| 2001/0009190 | A1 | * | 7/2001 | Frauhammer et al. | 173/93.5 |

FOREIGN PATENT DOCUMENTS

| | | | | |
|---|---|---|---|---|
| JP | 0335593 | A2 | * 10/1989 | B23B/31/12 |

* cited by examiner

*Primary Examiner*—Lynne H. Browne
*Assistant Examiner*—Katherine Mitchell
(74) *Attorney, Agent, or Firm*—M. Ralph Shaffer LLC

(57) ABSTRACT

Cable bolt wedge barrel, installation apparatus and method, for cable bolt installation in a mine borehole provided an interior resin system, wherein the wedge barrel of the cable bolt employed, and the tool used to revolve and supply thrust to the same, are mutually designed for (1) mutual, operative, wall-friction and/or end-detent drive engagement within a given torque range for the resin system employed, as applied by said tool, and (2) operative slippage when said range is exceeded, thereby precluding the emergence of the undesirable condition of over-mixing the resin system present in said borehole and consequent diminution of the resin system's holding power relative to the cable bolt within the borehole.

8 Claims, 5 Drawing Sheets

CABLE BOLT APPARATUS AND METHOD OF INSTALLATION FOR MINES

REFERENCE TO GOVERNMENT CONTRACTS

Not applicable.

CROSS REFERENCES TO RELATED APPLICATIONS

Not applicable.

BACKGROUND OF THE INVENTION

1 . The Field of the Invention

This invention relates to elongated cable bolts useful for installation, with cooperating resin systems, in boreholes in underground mines, to achieve ground control and, when installed in mine roofs, are useful, in combination with trussing systems, support plates and the like, for delimiting dilation of mine roofs, thereby contributing to safety of workmen and machinery and deterring mine roof collapse. In particular, the invention pertains to designing cable bolt proximal ends and torque-applying devices therefor, for permitting the application of both axial thrust and also torque to cable bolts, to thrust these into boreholes and simultaneously axially spin the cable bolts so as to mix to desired degree, and without over-mixing, the pre-implanted resin systems within the boreholes, whereby to allow the latter to cure in optimal fashion and secure properly the respective cable bolts within their respective boreholes at the bolts' distal ends.

2. Statement of Related Art

There is a great deal of prior art in the general field of cable bolts and their design, as well as torquing equipment for cable bolts. As to the present invention, the following art is noted: the article in "Wire Rope New & Sling Technology," p. 56 (citing U.S. Pat. No. 5,741,092), October 1998; also, U.S. Pat. Nos. 906,040; 1,590,200; 3,161,090; 3,940,941; 5,531,545 (the inventor herein being patentee); U.S. Pat. Nos. 5,511,909; 5,230,589; 5,259,703 and 5,951,064. Many additional patents and other literature are cited in these references as background, all of which are fully incorporated herein by way of reference.

The art of introducing resin system capsules in a mine borehole and then advancing these to the blind end of a borehole by a cable bolt backing the capsules is well known. The spinning of the cable bolt ruptures the capsules and mixes the resin system supplied. The mixing should continue until the resin has a particular viscosity, but should not be overmixed. Otherwise, the holding power of the resin, now disposed between the cable bolt shank and the wall of the borehole, will become lessened. Failure can occur, either when the cable bolt plus resin, pulls out of the hole when the bolt is placed in tension, or when the bolt simply pulls through the resin sleeve, or when simply the resin does not make a secure anchor with the surrounding strata of the borehole. Manufacturers specify optimal mixing time needed to achieve the viscosity desired and, hence, the point of maximum holding power. The present invention precludes the optimal mixing from being exceeded, by supplying a relief feature whereby the cable bolt is not spun further once a particular torque resistance level is reached. None of the above art and references, taken either singly or in combination, is believed to anticipate this invention as described below.

BRIEF SUMMARY OF THE INVENTION

The invention resides in the combination, and also in the individual constituents therein, of a cable bolt and a torquing tool, the latter to be secured in and revolved by conventional, installation power equipment, or simply rotated manually, whereby the cable bolt can be axially spun and thrust home, by such tool and, e.g., its power equipment, within a borehole. This is achieved by a new design of the proximal end of the cable bolt and the design of the tool by which such proximal end is engaged. Since cable bolts, owing to high-volume use, must be manufactured at low cost, reliance is made herein upon the wedge barrel of the cable bolt having an outer peripheral surface of revolution, free of radial projections, and reliance being made of either (1) designing the wedge barrel so that its outer surface is conically tapered inwardly toward said proximal end, for effecting a mutual conical frictional engagement as between the wedge barrel and the tool designed to drive the same, and/or (2) where the wedge barrel and tool have releasably inter-engaging undulations or protuberances, to effect a releasable keying of the tool to the collar, for accomplishing the spinning function, or both.

The method inherent in the invention in setting a cable bolt in a mine borehole, provided with resin, comprises the steps of: (1) providing a cable bolt having an elongated shank and a wedge barrel, provided a peripheral surface of revolution, fixed to said shank and constructed for operational, releasable engagement by a spin-and-axial-thrust providing tool; (2) providing a tool constructed and dimensioned for releasably engaging said wedge barrel in a manner whereby to axially spin said wedge barrel and thus said cable bolt through a predetermined permissible torque range and automatically to interrupt such axial spin function once said predetermined torque range is exceeded, and (3) operatively releasably engaging said tool with said wedge barrel. The over-all object of the invention is to provide, in a cable bolt structure and method of installing the same in a resin-provided borehole, both the means and the method of both spinning and thrusting home a cable bolt in its intended borehole and, in doing so, mixing the resin without chancing over-mixing the same, whereby to optimize the holding power of the resin anchor for the cable bolt.

The invention, both as to its objects and advantages, may best be understood by reference to the following description, taken in conjunction with the following drawings.

DETAILED DESCRIPTION OF PREFERRED EMBODIMENTS

Figure 1:
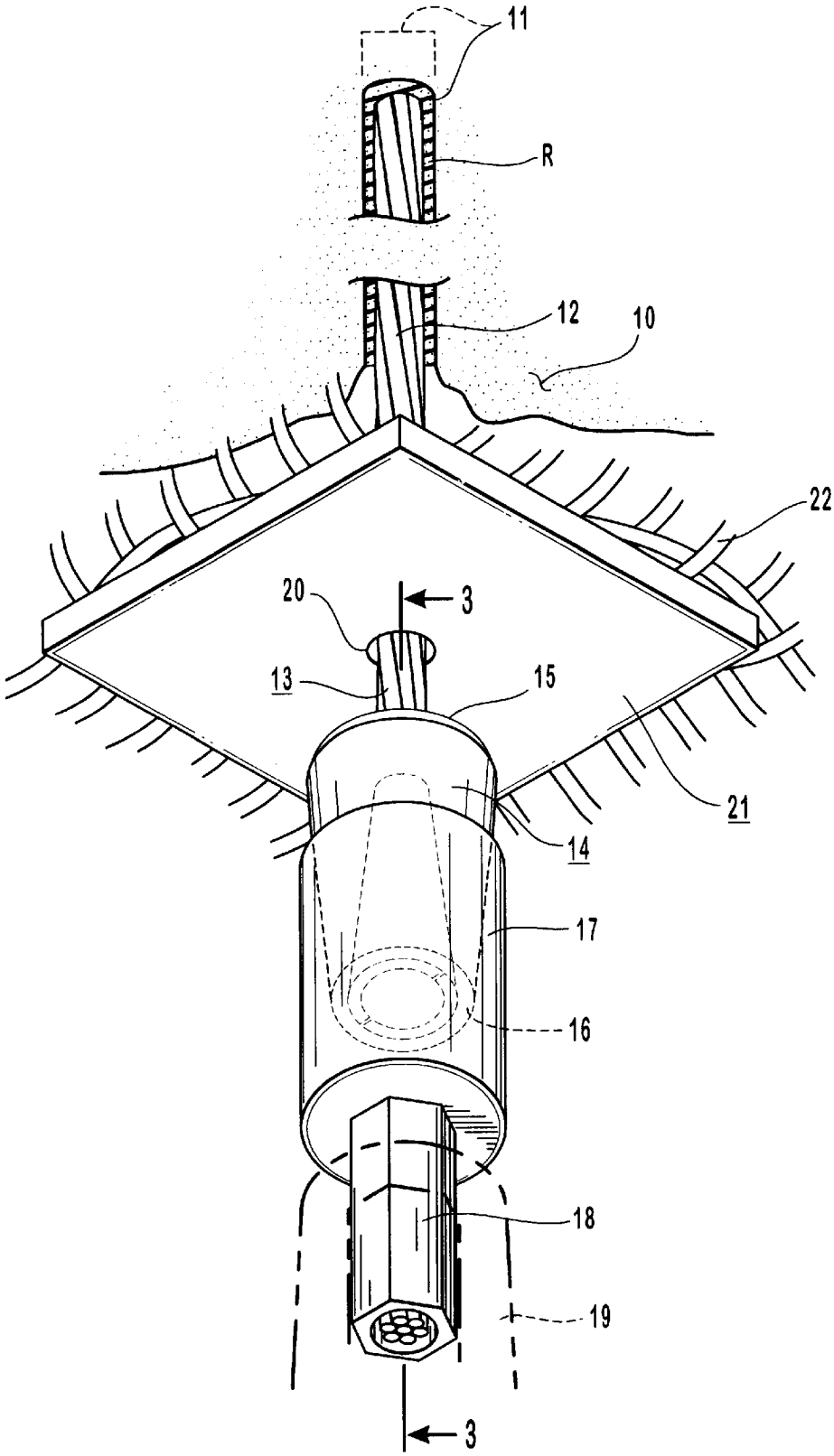
FIG. 1 is a perspective view of a cable bolt of the present invention, showing its installation in a borehole in an underground mine.

In FIG. 1 mine roof strata 10 is provided the borehole 11, having resin R, which receives the cable length 12 of cable bolt 13. Cable bolt 13 includes a wedge barrel 14 having a rounded end distal end 15. The proximal end 16 is received by the end of tool 17 that is driven by the shank 18 of standard installation mechanism 19. The cable length 12 proceeds through aperture 20 of support plate 21. Mesh 22 may be provided and be secured in place by support plate 21.

Figure 2:
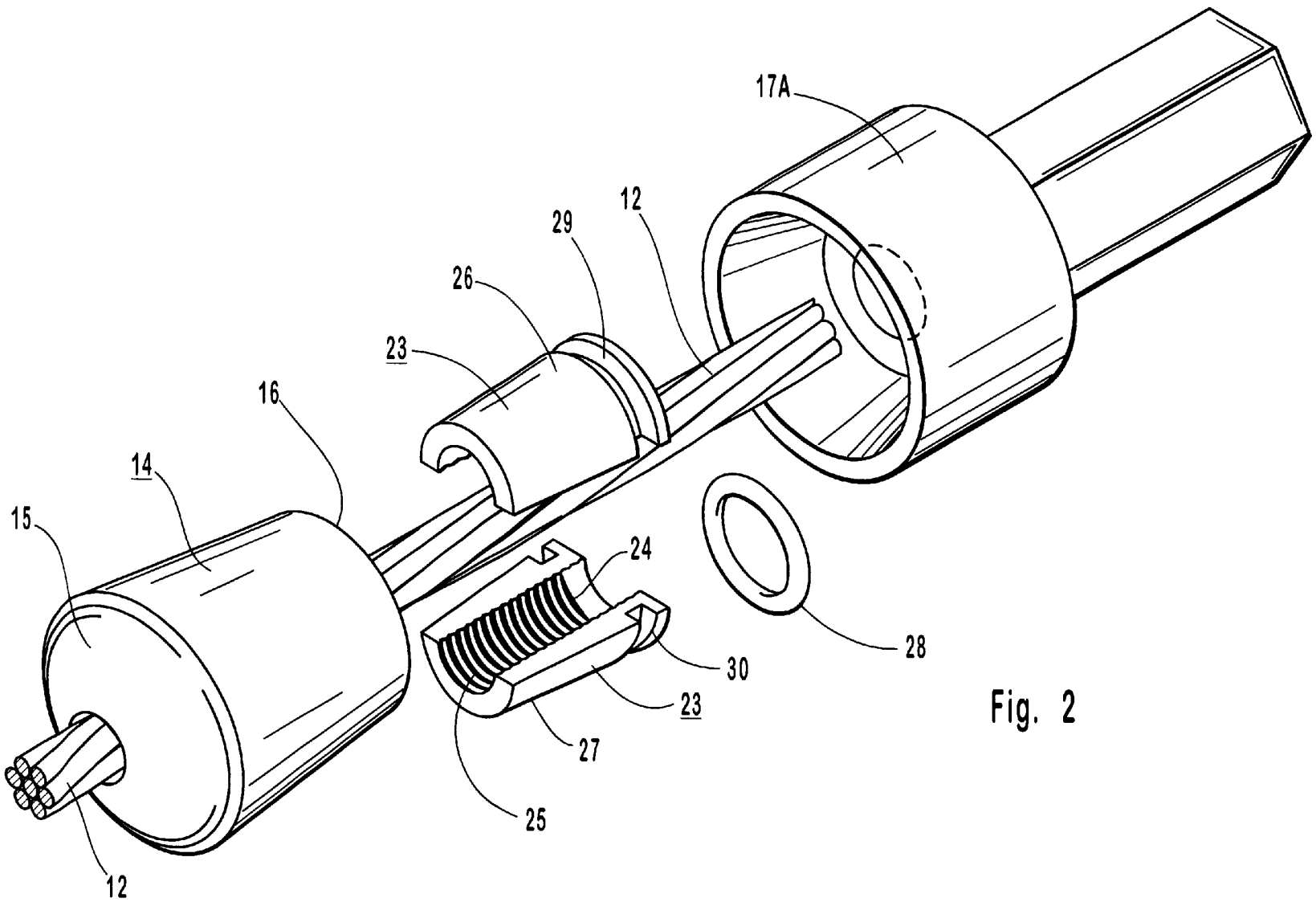
FIG. 2 is an exploded perspective of the cable bolt and torque producing tool, with the wedge elements which are supplied the wedge barrel of the cable bolt.

In FIG. 2 the cable bolt is seen to include a pair of wedge elements 23 each having a cylindrically formed inner surface 24 that is serrated at 25. In their combination, the wedge elements have a combined outer frusto-conical surface made up of peripheral surface segments 26 and 27. These aligned elements are preferably retained in place by an elastomeric O-ring 28, see FIG. 3A, when positioned in grooves 29 and 30. The wedge elements are received in the frusto-conical interior of the wedge barrel 14 as will hereafter be pointed out. Tool 17 may now take the form as shown at 17A.

Figure 3C:
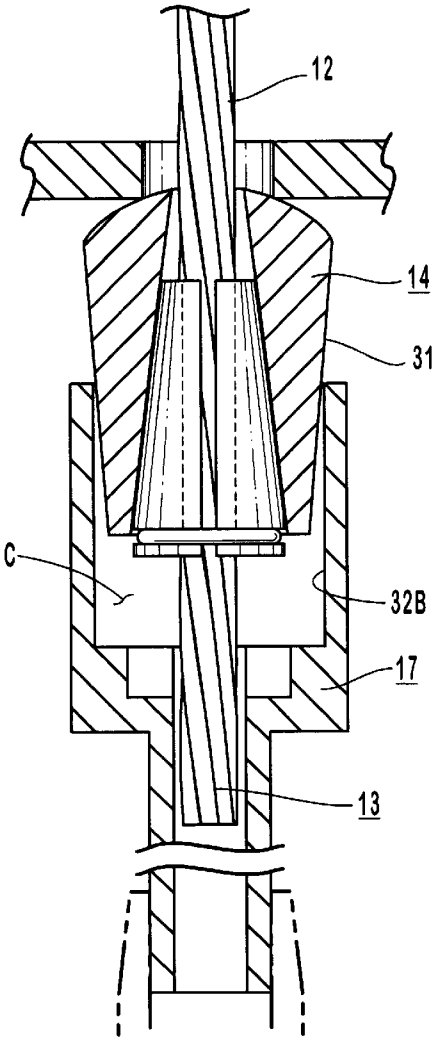
FIGS. 3A, 3B and 3C are longitudinal sections, taken along the line 3—3 in FIG. 1, illustrating equivalent, greater, and lesser conical interior taper of the tool of the torque producing device relative to the corresponding taper of the wedge barrel outer peripheral surface.
Figure 3B:
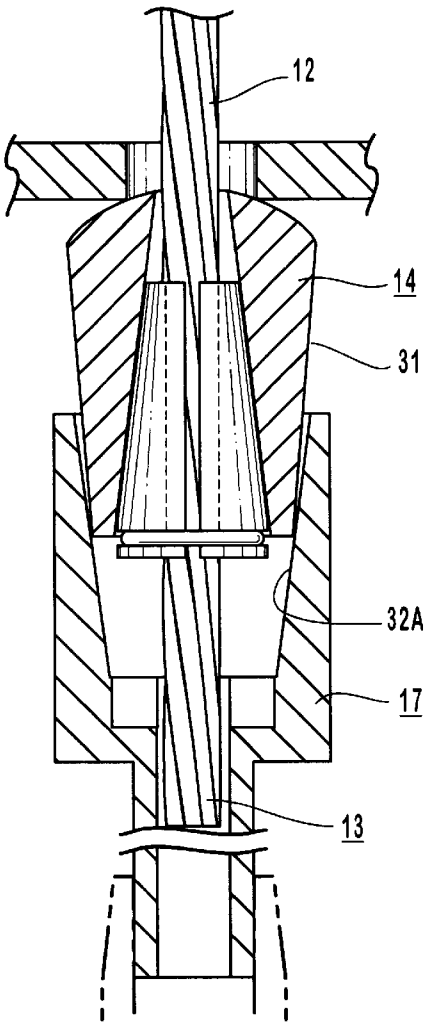
Figure 3A:
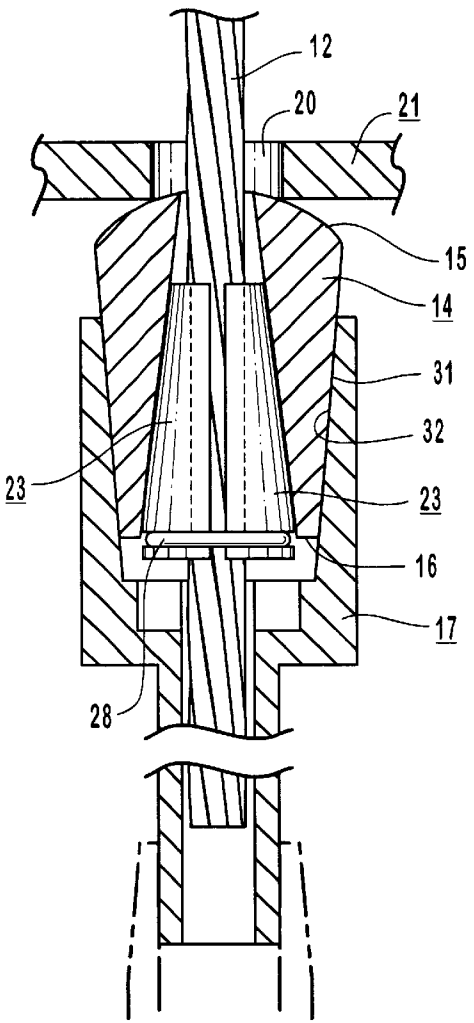

FIG. 3A illustrates that the distal end 15 of wedge barrel 14 is rounded so as to adjustably seat at aperture 20 of support plate 21. The position of proximal end 16 of the wedge barrel is likewise shown. In this figure the frusto-conically tapered interior wall 32, of tool 17, essentially exactly matches the frusto-conical peripheral surface of revolution 31 of the wedge barrel. Thus, a full friction contact is achieved as between the inter-cooperating and matching frusto-conical friction surfaces of the tool 17 and the wedge barrel 14. FIG. 3B illustrates the case where the interior wall at 32, now seen as 32A, has a more pronounced taper than that of surface 31 of the wedge barrel. This condition still enables the tool 17 to frictionally engage and rotate the wedge barrel about its axis, howbeit at a reduced inter-cooperating surface area. FIG. 3C illustrates the reverse case, wherein the taper at 32B, if any, of the interior cavity wall, of cavity C, of the tool 17 is less than the frusto-conical taper of peripheral surface 31 of wedge barrel 14. Here again, there will be some frictional engagement contact between a restricted wall area of tool 17 and the peripheral surface of wedge barrel 14. The frictional drive relative to FIGS. 3B and 3C will be somewhat less than the full surface friction drive of FIG. 3A. Nonetheless, all three embodiments will function satisfactorily in accordance with specific conditions present.

Figure 4:
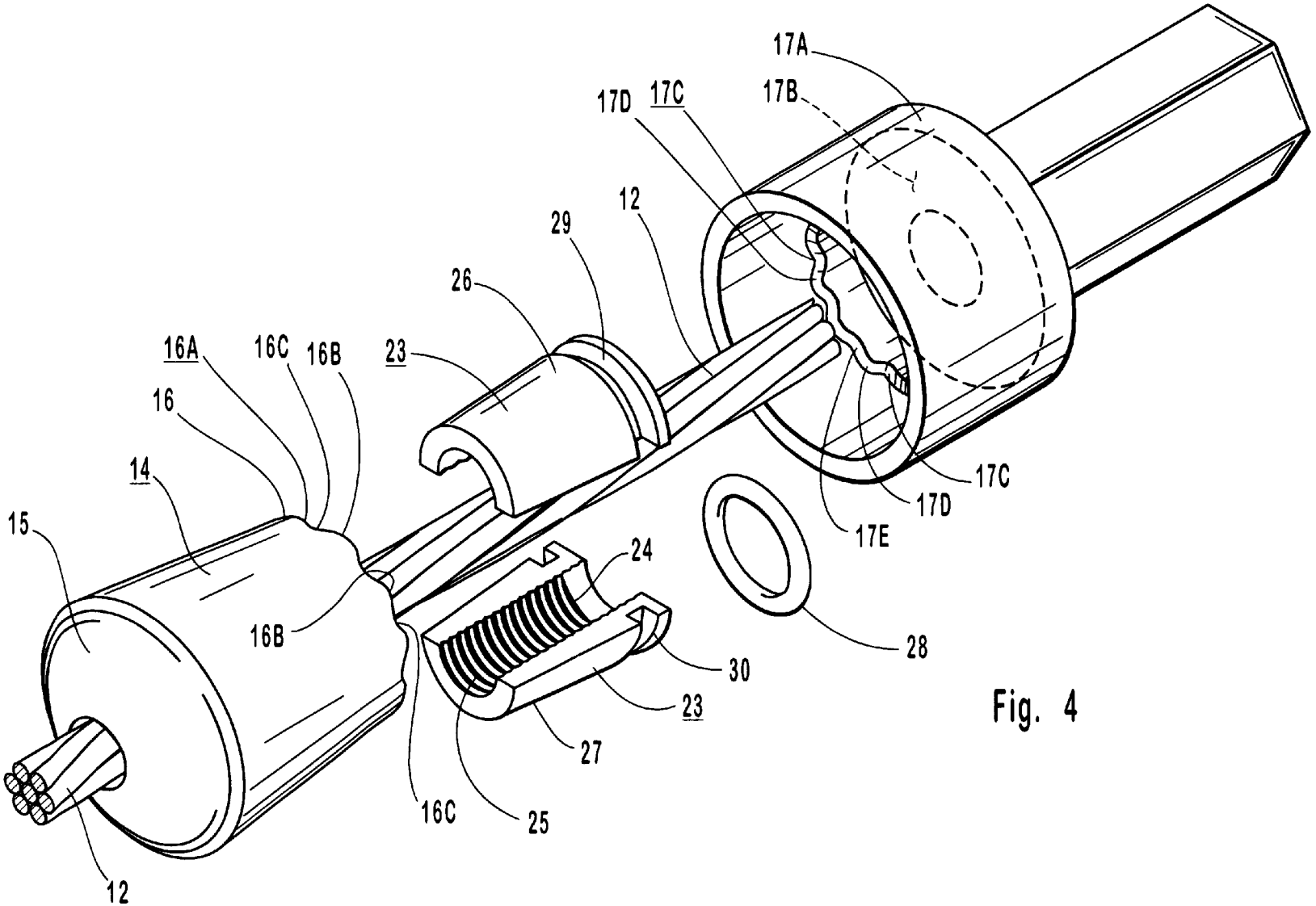
FIG. 4 is similar to FIG. 2 but illustrated a further embodiment wherein the proximal edge of the wedge barrel, as well as, e.g., the base interior of the tool, have mutually cooperative undulating surfaces which selectively engage for spinning the cable bolt about its central axis.
Figure 6B:
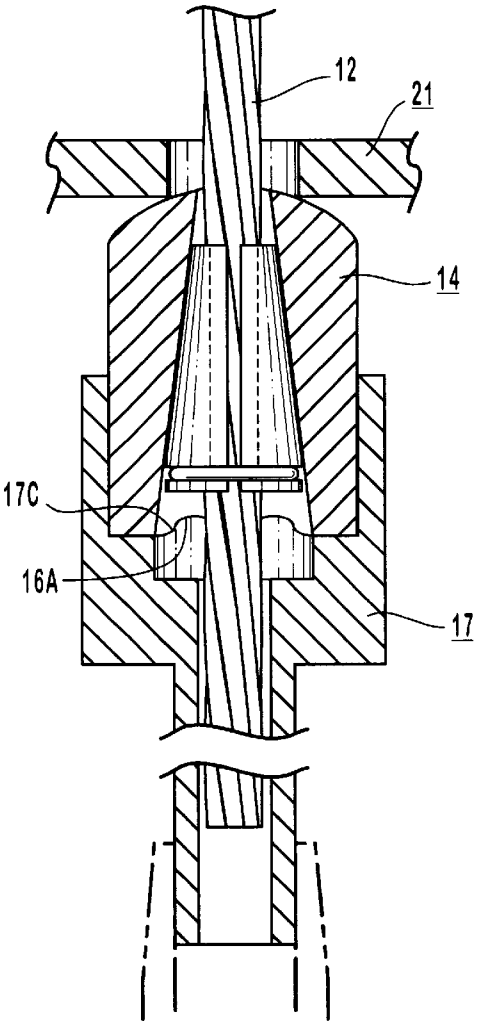
FIG. 6B is similar to FIG. 6A, but now showing the structure when the wedge barrel has a cylindrical exterior peripheral surface.
Figure 6A:
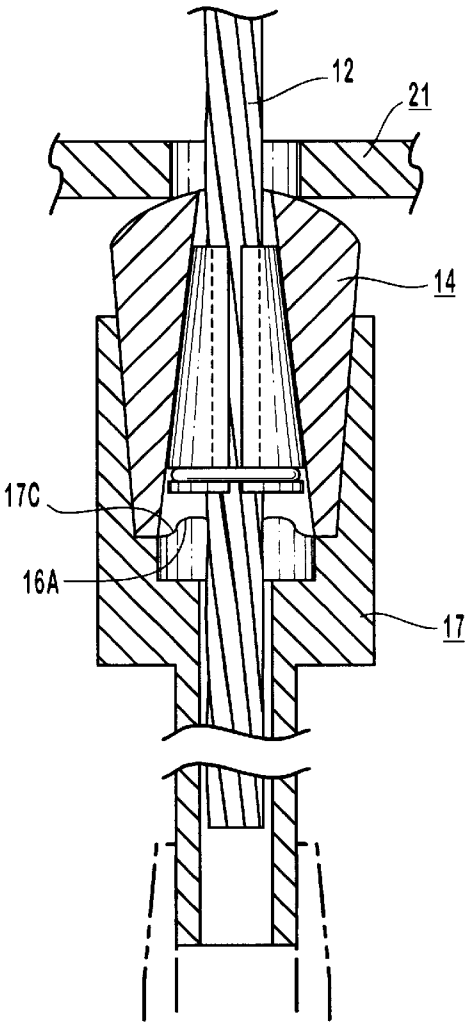
FIG. 6A is similar to FIG. 3A, but illustrates the engagement referred to in FIG. 5.
Figure 5:
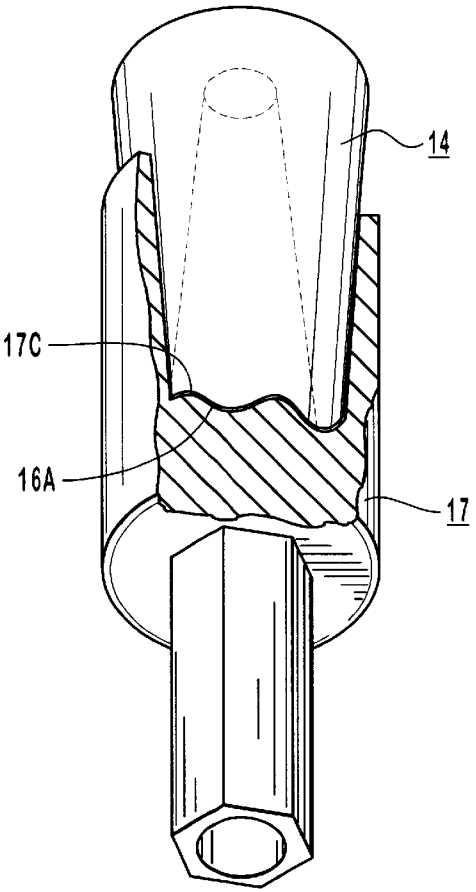
FIG. 5 illustrates the tool in engaged position relative to the undulating end surface of the wedge barrel.

FIG. 4 is similar to FIG. 2 but this time illustrates that the wedge barrel 14 may include a proximal end surface 16 having an undulating surface 16A comprised of a series of peaks, waves or protuberances 16B mutually spaced apart by valleys or troughs 16C. Correspondingly, the tool 17A may include a base 17B provided with an upstanding undulating surface 17C comprised of interspaced peaks 17D separated by troughs or valleys 17E. Accordingly, the tool may be brought into engagement with wedge barrel 14 both at the inter-cooperating frusto-conical frictional surfaces of the two and, in addition, the undulating surfaces of both parts will be brought together in a releasable, temporary, positive drive. When the viscosity of the resin R increases to an optimal point, for maximum holding power of the cable within the borehole, then the structure may be so designed such that the tool and its undulating surface will simply ride over the undulating surface of proximal end 16A so that no further rotation of the cable bolt takes place. FIG. 5 illustrates the condition just described prior to the torque threshold being achieved, at which point the tool backs off incrementally so as not to apply excess torque and additional spin to the cable bolt. FIGS. 6A and 6D are similar to FIGS. 3B and 3C, respectively, and this time illustrate the inter-cooperation of the corresponding undulating surfaces of the tool and wedge barrel.

In summary, the friction drive contact of the tool with wedge barrel 14 may be frusto-conical in nature, whereby to provide the necessary frictional drive to spin the cable bolt and advance the same along its central axis A. The tool, wedge barrel, and their inter-cooperating frusto-conical surfaces will be designed for specific, anticipated mine conditions such that, at and above a given torque threshold, the tool will spin over and not further rotate the cable bolt when optional resin viscosity, and the resultant holding power, is reached. In some instances it may be desirable to additionally include the undulating surfaces, inter-cooperating as between the wedge barrel and the torque-supplying tool so as to provide a positive spin to the cable bolt throughout a predetermined torque threshold. However, when that threshold is exceeded, then the tool will simply back off slightly and the undulations thereof will simply click over the corresponding undulations of the wedge barrel such that no further revolvement of the of the wedge bold barrel occurs. In this invention the method, inherent in the system, is to install a cable bolt in a mine borehole provided with resin, which comprises the steps of: (1) providing a cable bolt having an elongated shank and an enlarged head, e.g., wedge barrel, provided a peripheral surface of a revolution, fixed to said shank and constructed for operational, releasable engagement by a spin-and-axial-thrust providing tool; (2) providing a tool constructed and dimensioned for releasably engaging said enlarged head in a manner whereby to axially spin said head and thus said mine bolt through a predetermined permissible torque range and automatically to interrupt such axial spin function once said predetermined torque range is exceeded; and (3) operatively releasably engaging said tool with said enlarged head.

In brief summation: Standing alone, the concept of a wedge barrel having an interior conical taper of nominally 7 degrees, with corresponding wedges therein for gripping a cable bolt length passing through the wedge barrel or collar, is well known in the art and is widely practiced in the industry. The problem, heretofore, has been forming the proximal end of the barrel or collar, or the wedge elements themselves, with a positive drive head in the form of a hex-head, square head, or other non-circular head. This results in an undesirable, continuous positive drive wherein the torque imposed to spin the cable bolt is unrelieved even though the optimal point of resin mix and torque resistance is passed, resulting in a lessening of the holding power of the resin surrounding the cable length in the borehole. The present invention overcomes this difficulty by having the wedge barrel provided with an exterior peripheral surface of revolution, e.g., cylindrical or conical, which thereby does not serve as a non-circular positive drive. Where such surface is cylindrical, as in the present invention, then the end, and not the sidewall, is relied upon to produce the beginning operational engagement with the torque-supplying tool, by means of inter-engaging undulating end surfaces as between the wedge barrel and the tool. Consider the more or less pronounced degree of undulation lying between 0 to 1.0 being a smooth surface-contact and 1 being a normal or 90 degree relationship, i.e., square slots and cooperating square-formed protuberances; both of these extremes (0 and 1) the present invention avoids. Rather, the design of the undulations is between these two extremes such that slippage can and does occur automatically when a particular torque resistance threshold is reached. For some mines, both the feature above described and also the inter-engagement of frusto-conical frictional surfaces of the tool and wedge barrel may be advantageously employed. In such event, a frusto-conical taper, relative to the surface of revolution of the wedge barrel and the cooperative interior of the torque-applying tool may be desirable, as fully described above, for rotating the cable bolt by friction-drive below a torque threshold, and then permit any additional spinning the tool to occur over the non-rotating cable bolt when torque resistance, owing to the setting and viscosity of the borehole resin, exceeds a predetermined level. In all instances, the further mixing of the resin beyond its optimal threshold is discontinued.

While particular embodiments have been shown and described, it will be understood that various changes and modifications may be made without departing from the invention in its essential aspects and, therefore, the aim in the appended claims is to cover all such changes and modifications as fall within the true spirit and scope of the invention.

I claim:

1. In combination: a cable bolt provided with a cable shank for mounting in a borehole of mine strata, said borehole provided a resin system receiving said cable shank for mixing thereby, said cable bolt including an axially disposed wedge barrel, having distal and proximal opposite ends, fixed to said shank and having an outer peripheral surface of revolution free of radial projections; and first means releasably engaging said wedge barrel for applying axial thrust and also torque, within a limited range, to said wedge barrel, for revolving said cable bolt, said wedge barrel and first means being mutually constructed for automatically releasing, said wedge barrel from drive-engagement by said first means once a predetermined torque resistance, is reached, owing to the mixing of said resin system by said cable shank and elevation of resin viscosity to a particular level, and wherein said outer peripheral surface is frusto-conically tapered, tapering inwardly from said distal end to said proximal end, said first means having an interior cavity wall frusto-conically tapered in essential correspondence with said outer peripheral surface, for receiving and frictionally engaging said wedge barrel at said peripheral surface.

2. In combination: a cable bolt provided with a cable shank for mounting in a borehole of mine strata, said borehole provided a resin system receiving said cable shank for mixing thereby, said cable bolt including an axially disposed wedge barrel, having distal and proximal opposite ends, fixed to said shank and having an outer peripheral surface of revolution free of radial projections; and first means releasably engaging said wedge barrel for applying axial thrust and also torque, within a limited range, to said wedge barrel, for revolving said cable bolt, said wedge barrel and first means being mutually constructed for automatically releasing said wedge barrel from drive-engagement by said first means once a predetermined torque resistance, is reached, owing to the mixing of said resin system by said cable shank and elevation of resin viscosity to a particular level, and wherein said wedge barrel has a proximal end provided with an undulating surface, said first means also having a corresponding undulating surface essentially matching said undulating surface of said proximal end, the two undulating surfaces being engaged during a predetermined torque range and then becoming automatically operatively-disengaged when a given permissible torque threshold is reached.

3. In combination: a cable bolt provided with a cable shank for mounting in a borehole of mine strata, said borehole provided a resin system receiving said cable shank for mixing thereby, said cable bolt including an axially disposed wedge barrel, having distal and proximal opposite ends, fixed to said shank and having an outer peripheral surface of revolution free of radial projections; and first means releasably engaging said wedge barrel for applying axial thrust and also torque, within a limited range, to said wedge barrel, for revolving said cable bolt, said wedge barrel and first means being mutually constructed for automatically releasing said wedge barrel from drive-engagement by said first means once a predetermined torque resistance, is reached, owing to the mixing of said resin system by said cable shank and elevation of resin viscosity to a particular level, and wherein said first means comprises a tool having an inner, frusto-conically tapered cavity.

4. In combination: a cable bolt provided with a cable shank for mounting in a borehole of mine strata, said borehole provided a resin system receiving said cable shank for mixing thereby, said cable bolt including an axially disposed wedge barrel, having distal and proximal opposite ends, fixed to said shank and having an outer peripheral surface of revolution tree of radial projections; and first means releasably engaging said wedge barrel for applying axial thrust and also torque, within a limited range, to said wedge barrel, for revolving said cable bolt, said wedge barrel and first means being mutually constructed for automatically releasing said wedge barrel from drive-engagement by said first means once a predetermined torque resistance, is reached, owing to the mixing of said resin system by said cable shank and elevation of resin viscosity to a particular level, and wherein said first means includes an inner cavity having a circular, undulating engagement surface for engaging said wedge barrel.

5. A cable bolt wedge barrel having: a central axis and proximal and distal opposite ends; a wedge-receiving, frusto-conical interior wall tapered inwardly in one axial direction toward said distal end; and a frusto-conical, exterior, peripheral, friction surface of revolution tapered inwardly in the reverse axial direction toward said proximal end.

6. A cable bolt wedge barrel having: a central axis and proximal and distal opposite ends; a wedge-receiving, frusto-conical interior wall tapered inwardly in one axial direction toward said distal end; and a frusto-conical, exterior, peripheral, friction surface of revolution tapered inwardly in the reverse axial direction toward said proximal end, and wherein said proximal end has at least one tool-engaging undulation.

7. A cable bolt wedge barrel having: a central axis and proximal and distal opposite ends; a wedge-receiving, frusto-conical interior wall tapered inwardly in one axial direction toward said distal end; and a frusto-conical, exterior, peripheral, friction surface of revolution tapered inwardly in the reverse axial direction toward said proximal end, and wherein said proximal end has an undulation-provided, tool-engaging, coaxially projecting end surface.

8. A cable bolt wedge barrel having: a central axis and proximal and distal opposite ends; a wedge-receiving, frusto-conical interior wall tapered inwardly in one axial direction toward said distal end; and an exterior, peripheral, surface of revolution free of radial projections, said proximal end having a tool-engaging, undulation-provided, coaxially-projecting end surface constructed for receiving in releasable matching engagement an external, torque-producing tool.

* * * * *